United States Patent [19]

Brunton

[11] Patent Number: 4,488,321

[45] Date of Patent: Dec. 18, 1984

[54] CONCEALED RECESSED URINAL

[76] Inventor: Bruce A. Brunton, 1207 N. Sixth St., Chillicothe, Ill. 61523

[21] Appl. No.: 470,388

[22] Filed: Apr. 18, 1983

[51] Int. Cl.[3] ..... E03D 13/00

[52] U.S. Cl. ..... 4/301; 4/307; 4/300.3; 4/DIG. 2

[58] Field of Search ..... 4/307, DIG. 2, 312, 4/301, 300.3

[56] References Cited

U.S. PATENT DOCUMENTS

| | | | |
|---|---|---|---|
| 180,689 | 8/1876 | Wilson | 4/307 |
| 202,193 | 4/1878 | Reid | 4/307 |
| 819,562 | 5/1906 | Lazear | 4/312 X |
| 2,076,950 | 4/1937 | Koch | 4/DIG. 2 |
| 2,678,450 | 5/1954 | Simpson et al. | 4/DIG. 2 |
| 3,742,522 | 7/1973 | Stevenson | 4/DIG. 2 |
| 4,366,584 | 1/1983 | Mchuma | 4/DIG. 2 |

FOREIGN PATENT DOCUMENTS

| | | | |
|---|---|---|---|
| 1236245 | 6/1960 | France | 4/310 |
| 1352 | of 1877 | United Kingdom | 4/307 |

*Primary Examiner*—Henry K. Artis

*Attorney, Agent, or Firm*—Marvin N. Benn; Milton S. Gerstein

[57] ABSTRACT

A concealed recessed urinal system in which a urinal is hidden from view by means of a frame mounted in a wall with hinged doors which, when opened, allow a drip guard to pivot outwardly. The system is flushed by a conventional water supply and activated by a valve. The urinal is a sanitary device for catching and disposing of human liquid waste.

16 Claims, 5 Drawing Figures

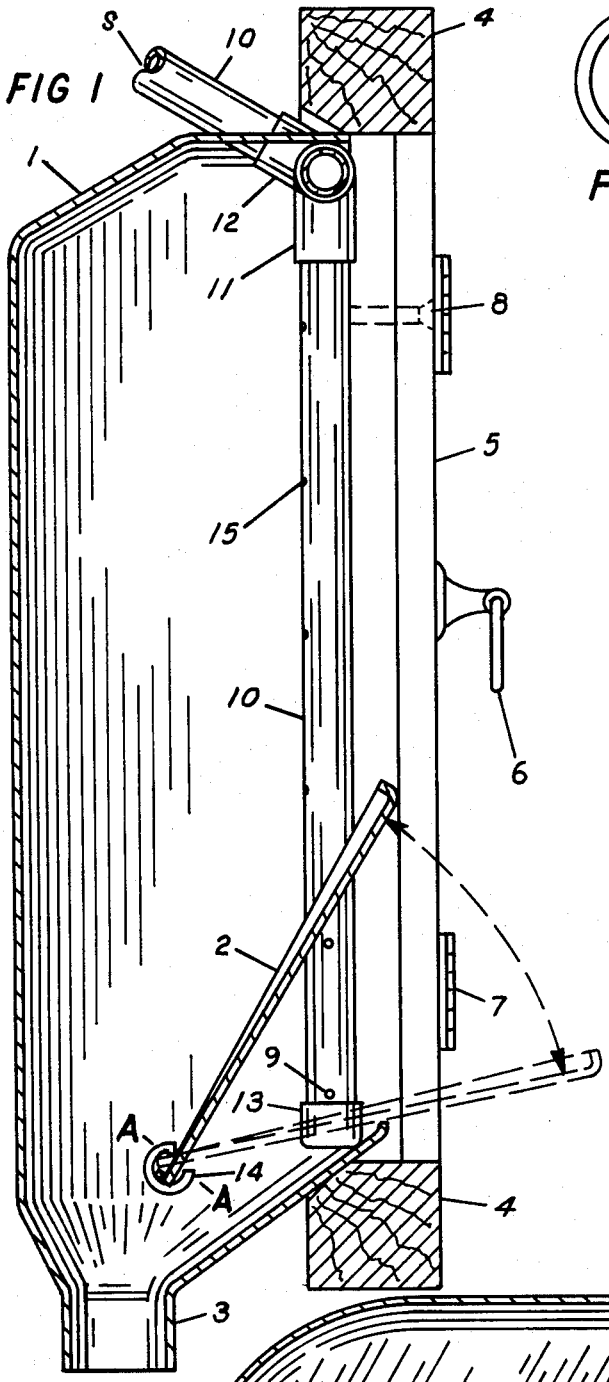
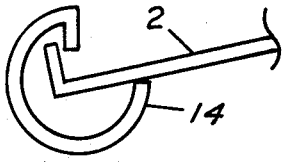
FIG 5
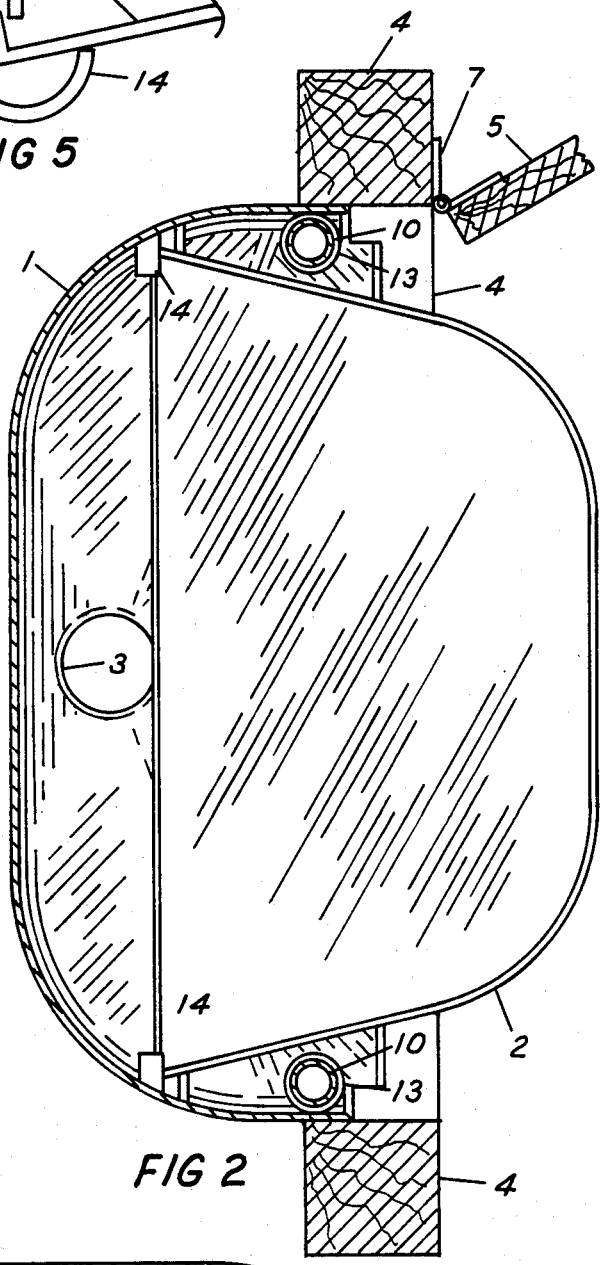
FIG 2
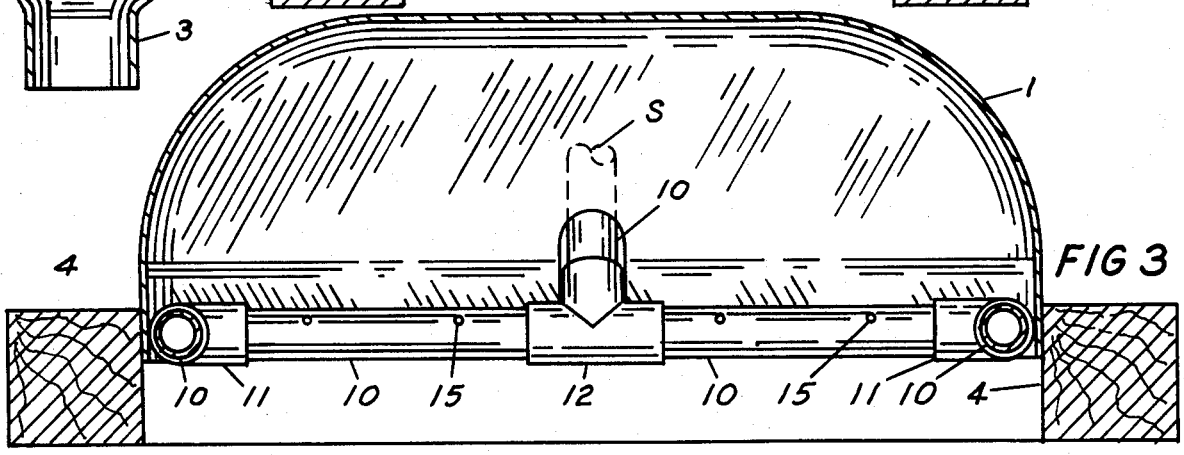
FIG 3

CONCEALED RECESSED URINAL

BACKGROUND OF THE INVENTION

Heretofore, urinals, being useful due to efficient economical operation, ecological considerations, and the conservation of water, still leave alot to be desired in that their high cost, their graceless appearance and the necessary and extensive remodeling required in existing houses have caused unfavorable public opinion. People hesitate to invest in a private urinal that looks just like a urinal.

To overcome these shortcomings, the concealed recessed urinal of the present invention not only will be more appealing to the eye, but the cost of manufacture is relatively lower than other similar devices, and is, therefore, within the financial means of the average working person. Furthermore, the preassembled unit of the present invention is to be recessed between existing studding, through an opening in a wall that is cut 12 inches wide and at a suggested height of 39 inches cut to the floor, the cut-out is to be shortened by 15 inches, the remainder being edged by trim supplied, which may be used as an inconspicuous plumbers door. The unit is to be secured to the upper end of the opening by means of screws through the frame. The plumbers door provides access for facilitating supply line and sink-type drain hookup. Therefore, the ease of installation in existing walls also aids in making the unit desirable and novel. A push button valve, at the purchasers discretion, may be mounted in the wall above the urinal, or may be mounted up through the floor.

SUMMARY OF THE INVENTION

The urinal of the present invention is a system that enhances the heretofore customary use of a urinal in that the receptacle of the concealed recessed urinal is designed and made in such fashion as to be almost completely recessed into the wall. The unit is mounted by a frame with affixed doors as an ultimate means of concealment. The receptacle and frame are permanently connected by attachment with brass nails, which are then covered over by placement of a flush means. The unit is to be wall mounted by use of screws through the frame. Said screws are covered by door hinges.

Another object of the present invention is the provision of a pivoted drip guard in order to more adequately collect undesired urine splatter. The drip guard, though held in place by pivot brackets of the receptacle by means of a lipped catch, can be easily removed in order to facilitate periodic cleaning of the unit.

Another object of the present invention is the provision of a flush system that is an inverted, U-shaped assembly of vinyl tubing and fittings provided with numerous holes which are aimed effectively so as to efficiently flush clean the receptacle.

A further object of the present invention is the provision of a stub drain pipe affixed in the bottom of the receptacle so that a waste trap hook-up may be provided that is in compliance with the plumbing code.

BRIEF DESCRIPTION OF THE DRAWINGS

Other objects and advantages of the invention will become more apparent from the specification taken in conjunction with the accompanying drawings, in which:

FIG. 1 is a side view of the assembled urinal of the present invention;

FIG. 2 is a top view of the bottom portion of urinal.

FIG. 3 is a top view of the top portion of the urinal;

FIG. 5 is a cross-sectional view taken along line A—A of FIG. 1.

DETAILED DESCRIPTION OF THE INVENTION

Figure 4:
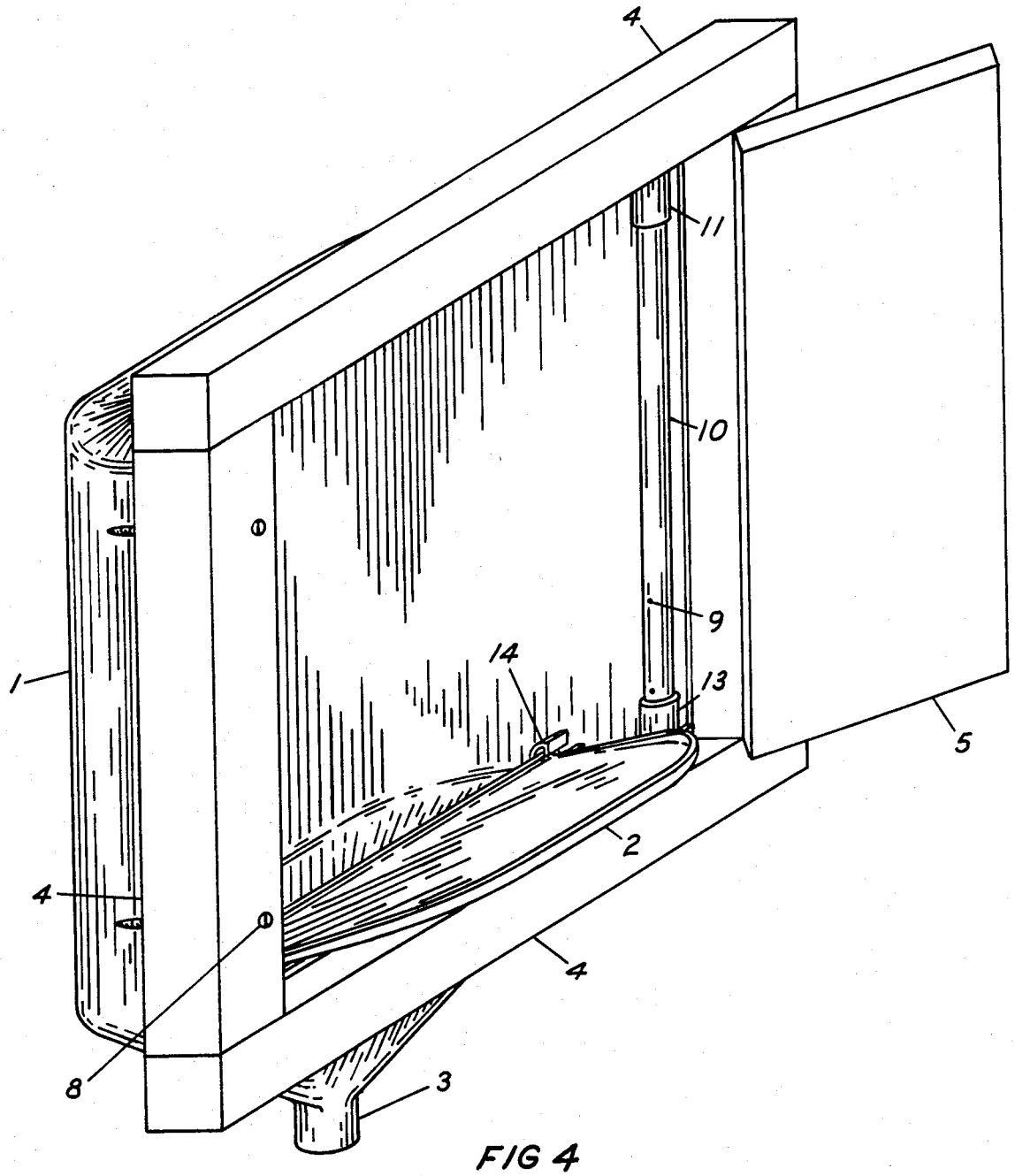
FIG. 4 is a front perspective view of the assembled urinal with one door unattached.

Referring to FIG. 1, reference numeral 1 designates the receptacle of the present invention which consists of structurally sound and corrosive-resistant, workable, nonmetallic materials consisting of, or a combination of, plastic, plexiglass, polyester resin and fiberglass. The entire receptacle is of one-piece construction consisting of the back which wraps or curves around to form the sides plus top, bottom and lower front portion. Colored plastic is to be used. Numeral 2 designates the pivotal drip guard or collector, and is made of the same materials as is the receptacle. Numeral 3 refers to a lipped P.V.C. drain pipe which is glued to the receptacle through an opening in the bottom. Numeral 4 designates the mounting frame. In FIG. 4, numeral 5 points out the doors. Close or opened, the doors and the drip guard is caused or allowed to pivot in an upward or outward motion, respectively. Due to the light weight and degree of incline of the drip guard when in its raised position, it has been concluded that door fasteners are unnecessary. Plywood and wood products are the desired material to be used in the frame and doors. However, plastics, plexiglass or fiberglass may be used. All types of available hardware styles may be used. Numeral 6 designates handles, knobs or ring pulls. Numeral 7 refers to the hinges, any style being intended. The hinges are intentionally offset in order to gain a wider swing of the doors. In FIG. 4, numeral 8 designates the mounting screws which, when in place, will be covered by placement of the hinges. In FIGS. 1 and 3, numeral 9 refers to the location of brass nails used to attach the receptacle to the frame. However, this nailing method is subject to change in favor of a flange-groove means between the receptacle and the frame. Numeral 10 refers to the P.V.C. tubing. Numeral 11 refers to a 90° P.V.C. elbow. Numeral 12 refers to the P.V.C. tee. Numeral 13 designates the P.V.C. end cap plug. In lieu of items 10, 11, 12 and 13, the U-shaped flush means may be premolded and incorporated into the structure of the receptacle. Numeral 14 refers to the pre-molded pivot bracket in the receptacle housing. The back edge of the drip guard and the apex of the pivot bracket are both opposingly lipped in such manner as shown in FIG. 5, so as to hinder the possibility of dislocation of the drip guard. Numeral 15 points to locations of numerous apertures pre-molded or pre-drilled in certain locations so as to allow the water supply, when introduced, to flush the urinal. Letter "s" denotes location of water supply hook-up.

The disclosure of the invention described hereinabove represents the preferred embodiments of the invention; however variations thereof, in the form, construction, and arrangement of the various components thereof and the modified application of the invention are possible without departing from the spirit and scope of the invention as set out in appended claims.

I claim:

1. A concealed recessed urinal system for use in a home, office, and the like, comprising:

a main frame for mounting the urinal system in a cut-out of a wall of a home, or the like;

a fixed, non-movable receptacle portion mounted in and by said main frame for receiving therein waste products deposited therein, said receptacle having a rear partition, a first side wall partition, and a second side wall partition, said first and second side wall partitions extending from opposite ends of said rear partition and projecting therefrom so as to define a hollow interior portion in which is received the waste products deposited in said receptacle; said receptacle further comprising a funnel-shaped bottom portion projecting away from said first and second side wall partitions and connected to said first and second side wall partitions at the lower edge surface of each, said funnel-shaped bottom portion having an opening formed therein through which the waste products deposited in said receptacle exit;

flushing means, at least a portion of which is mounted in the hollow interior of said receptacle for providing streams of water to flush away the waste products deposited in said receptacle, the streams of water exiting along with the waste products through said opening formed in said funnel-shaped bottom portion of said receptacle;

drip guard means pivotally mounted in said receptacle, in the hollow interior thereof, said drip guard means comprising a plate having a rear edge surface pivotally mounted in the rear portion of said receptacle, and a forward edge surface spaced from said rear edge surface and projecting away from said rear edge surface in a direction away from said rear partition toward the open front of said receptacle, said plate having a length taken in the direction from said rear edge surface to said front edge surface such that when said plate is in its downward and outwardly projecting position, said forward edge surface projects beyond the boundary of said receptacle through the open front thereof whereby waste products are prevented from being deposited in unwanted places, said plate having a center of gravity such that said plate always tends to pivot about said rear edge surface so as to urge said front edge surface to project outwardly through the open front of said receptacle when said plate is not constrained from pivotal movement;

means for pivotally mounting said rear edge surface of said plate in said receptacle away from the open front thereof; and closure means pivotally mounted on said main frame for closing off the open front of said receptacle when the urinal system is not being used, said closure means being operatively associated with said plate so that when said closure means are closed to cover up the open front of said receptacle, said plate is caused to pivot such that said forward edge surface of said plate is pivotted away from the open front of said receptacle to lie completely within the hollow interior of said receptacle, so that said forward edge surface cannot project through the open front.

2. The concealed recessed urinal system according to claim 1, wherein said means for pivotting said plate comprises a pair of brackets mounted in the hollow interior of said receptacle, each of said brackets comprising a curved retaining means having a hollow interior, said retaining means further having an opening formed along a portion of its circumference for allowing entry into said hollow interior, said pair of brackets being spaced apart in said receptacle for mounting said rear edge surface of said plate; said retaining means of each of said brackets further comprising a lip projecting into the hollow interior of said retaining means, said lip having a first end connected to a portion of the circumference of said retaining means, and a second end spaced from said first end and projecting inwardly into said hollow interior of said retaining means.

3. The concealed recessed urinal system according to claim 2, wherein said rear edge surface of said plate comprises an angular flange portion projecting at an angle from said rear edge surface and at an angle relative to the remainder of said plate, said rear edge surface of said plate being mounted within the hollow interior of each said retaining means, such that said plate is contained in said retaining means.

4. The concealed recessed urinal system according to claim 3, wherein said flange means of said rear edge surface of said plate extends substantially across the entire width of said plate, said width being taken in a direction transverse to the length of said plate from said first side wall partition toward said second side wall partition and said pair of brackets being mounted in said receptacle by said first and second side wall partitions so that one of said bracket means is mounted to one of said first and second side wall partitions.

5. The concealed recessed urinal system according to claim 4, wherein said closure means comprises a pair of doors, each of said pair of doors closing half of the open front of said receptacle when said pair of doors are in their closed positions; and means for pivotally mounting said pair of doors to said main frame for pivotal movement between open and closed positions.

6. The concealed recessed urinal system according to claim 4, wherein said flushing means comprises a pipe means extending through the hollow interior of said receptacle along at least one of said first and second side wall partitions, said pipe means having a series of holes formed therein for the exit therethrough of water to provide streams of flusing water for the waste products deposited in said receptacle; said pipe means further having means connected to a water supply in order to supply water to the hollow interior of said receptacle.

7. The concealed recessed urinal system according to claim 1, wherein said opening formed in said bottom portion of said receptacle lies adjacent said rear partition of said receptacle, said rear edge surface of said plate being spaced from said rear partition of said receptacle a greater distance than the distance said opening is spaced from said rear partition, so that said rear edge surface of said plate is spaced from said opening and the circumference of said opening in a direction taken from said rear partition toward the open front of said receptacle, so that waste products deposited upon the surface of said plate will fall therefrom into the opening.

8. The concealed recessed urinal system according to claim 7, wherein said main frame comprises limit means for limiting the pivotal rotation of said plate, said limit means limiting the rotation of said plate such that at its limit, said plate is inclined with the slope of the incline rising from said rear edge surface of said plate to said forward edge surface of said plate in order to cause waste products deposited thereon to descend into the hollow interior of said receptacle and fall into said opening of said bottom portion.

9. The concealed recessed urinal system according to claim 6, wherein said pipe means extends along at least one of said first and second side wall partitions at a portion thereof spaced from said rear edge surface of said plate in a direction taken from said rear edge surface toward said forward edge surface of said plate, so that when said flushing means is operated, the streams of water thus generated fall upon at least a portion of the upper surface of said plate means to wash away any waste products deposited thereon.

10. The concealed recessed urinal system according to claim 9, wherein said series of holes extend along the length of said pipe means substantially along the entire length thereof, all of said holes of said series of holes lying above said upper surface of said plate when said plate is pivotted to its limit to cause said forward edge surface of said plate to project outwardly of the open front of said receptacle.

11. The concealed recessed urinal system according to claim 1, wherein said main frame is mounted to said receptacle at the forward edge surfaces of said first and second side wall partitions such that said receptacle projects rearwardly away from said main frame, said main frame having an opening cooperating with the open front of said receptacle to provide one continuous access opening to the hollow interior of said receptacle; said main frame further having a lower cross piece extending across and forward of said bottom portion of said receptacle, said bottom portion of said receptacle having an elongated abutment portion projecting upwardly and into said access opening formed by the open front of said receptacle and the cooperating opening of said main frame, said elongated abutment portion providing the limit of pivotal rotation of said plate when said plate is allowed to pivot to allow projection of said forward edge surface of said plate through the open front of said receptacle.

12. The concealed recessed urinal system according to claim 11, wherein said flushing means comprises pipe means extending along at least one of said first and second side wall partitions, said pipe means having a first end approximately on the same horizontal level as said elongated abutment portion of said bottom portion of said receptacle, said pipe means having a series of holes formed along substantially the length thereof by which streams of water exit to fall upon said elongated abutment portion and to fall upon the upper surface of said plate; said elongated abutment portion being inclined and sloping upwardly from adjacent said opening of said bottom portion toward the open front of said receptacle.

13. The concealed recessed urinal system according to claim 1, wherein said rear edge surface of said plate is pivotally mounted in said receptacle closer to said rear partition than to the open front of said receptacle in order to cause a torque by the center of gravity of said plate, so that said forward edge surface of said plate is always biased outwardly toward the open front of said receptacle.

14. The concealed recessed urinal system according to claim 13, wherein said closure means comprises at least one door for closing off the open front of said receptacle, said at least one door being mounted to a portion of said main frame for forcing said forward edge surface of said plate back into the hollow interior of said receptacle when said at least one door is closed against the open front.

15. The concealed recessed urinal system according to claim 14, wherein said main frame comprises a crosspiece adjacent and forward of said bottom portion of said receptacle, said bottom portion comprising an elongated sloping surface having a first end adjacent said opening of said bottom portion and a second end abutting against and extending above said crosspiece of said main frame, said elongated sloping surface inclining from said first end thereof to said second end thereof, said forward edge surface of said plate resting upon said second end of said elongated sloping surface of said bottom portion when said at least one door is in its opened non-contacting position, whereby said second end of said elongated sloping surface serves as an abutment stop to the rotation of said plate.

16. The concealed recessed urinal system according to claim 15, wherein said second end of said elongated sloping surface of said bottom portion lies in a horizontal plane at least at the same elevation as a horizontal plane containing therein the upper-most portion of the outer circumference of said bracket means, so that said forward edge surface of said plate is always at a higher elevation relative to said rear edge surface of said plate for all positions of said plate, thereby always providing a slanted upper plate surface upon which waste products descend from said forward edge surface to said rear edge surface.

* * * * *